United States Patent [19]

Gazzera

[11] Patent Number: 4,585,172

[45] Date of Patent: Apr. 29, 1986

[54] HYDRAULIC ACTUATION

[75] Inventor: Raymond W. Gazzera, Scottsdale, Ariz.

[73] Assignee: The Garrett Corporation, Los Angeles, Calif.

[21] Appl. No.: 540,574

[22] Filed: Oct. 7, 1983

[51] Int. Cl.[4] ..... F15B 21/04

[52] U.S. Cl. ..... 239/265.33; 60/230; 60/453; 92/5 L; 92/5 R; 92/78; 91/44; 91/520; 91/417 R

[58] Field of Search ..... 92/5 L, 78, 5 R; 91/44, 91/520, 417 R; 60/546, 453, 230; 239/265.33

[56] References Cited

U.S. PATENT DOCUMENTS

| | | | |
|---|---|---|---|
| 2,568,561 | 9/1951 | Perdue et al. | 92/5 L |
| 2,808,810 | 10/1957 | Lindley | 92/5 L |
| 2,929,212 | 3/1960 | Lewis et al. | 60/453 |
| 3,579,989 | 5/1971 | Stark et al. | 60/546 |
| 3,958,420 | 5/1976 | Yokota | 60/453 |
| 4,343,226 | 8/1982 | Ribeiro de Almeida | 91/520 |
| 4,485,725 | 12/1964 | Tootle | 91/417 R |

FOREIGN PATENT DOCUMENTS

| | | | |
|---|---|---|---|
| 90540 | 10/1983 | European Pat. Off. | 92/5 L |
| 517314 | 1/1940 | United Kingdom | 91/520 |
| 573617 | 9/1977 | U.S.S.R. | 91/520 |

OTHER PUBLICATIONS

Hydraulics & Pneumatics, *How to Avoid Aeration in Hydraulic Circuits,* Hayward, A. T. J. 11/1963, pp. 79–83.

*Primary Examiner*—Robert E. Garrett
*Assistant Examiner*—Richard S. Meyer
*Attorney, Agent, or Firm*—Terry L. Miller; Albert J. Miller

[57] ABSTRACT

Apparatus and method for hydraulic actuation via multiple synchronized hydraulic motors with air purging, synchronizing, and force limiting features.

22 Claims, 12 Drawing Figures

HYDRAULIC ACTUATION

BACKGROUND OF THE INVENTION

The field of this invention is apparatus and methods for actuation or movement of a load member by two or more synchronized hydraulic motors. More particularly, this invention relates to apparatus and methods for moving a control portion of an aircraft via hydraulic motors. Specifically, this invention relates to apparatus and methods for moving thrust reverser structure associated with an aircraft jet propulsion engine between deployed and stowed positions via multiple synchronized motors of the extensible type wherein such motors are hydraulically powered. Synchronization of such hydraulic motors is maintained during their operation despite load variations therebetween. The force which the motors may exert upon the thrust reverser structure may be limited to a predetermined value.

A number of conventional actuation systems having multiple synchronized hydraulic motors are known. These conventional systems may be conveniently classified into three groups, as follows: First, systems having a servo valve or valves feed back coupled with the load member and controlling the flow of hydraulic pressure fluid to the motors. Second, systems employing a flow distributor to apportion hydraulic pressure fluid flow among the motors. Third, systems having cross-connected or cascade-connected working or synchronization volumes in the various motors so that movement of one motor causes corresponding movement of the cross-connected motor. Of course, some conventional systems are hybrids of the above three groups. For example, a flow distributor may take the form of a flow sensor controlling a servo valve or valves. Further, a cross-connected system may include a servo valve controlling the flow of pressure fluid to the working volumes of the motors. Regardless of the particular form taken by conventional systems for synchronizing hydraulic motors, these conventional systems suffer from many deficiencies. Among these deficiencies are undue complexity, a failure to precisely synchronize the motors, difficulty in purging air from the system, and the concentration of applied force in one motor should a jam of the load member occur.

U.S. Pat. Nos. 3,476,016; 2,759,330; 2,286,798 and 3,855,794 illustrate conventional synchronized hydraulic motor systems.

In view of the recognized deficiencies of conventional hydraulic actuation systems, such hydraulic actuation has heretofore been considered inappropriate for use in moving aircraft control structures such as thrust reverser structure. Consequently, the most common device employed for deploying and stowing aircraft thrust reversers are ball screw units. Each thrust reverser conventionally is moved by two or more ball screw units which are synchronized by gears and shafting which cross couples the ball screws. The screws can be individually driven by hydraulic motors, or the entire group can be driven by one motor.

Such ball screw type of actuators also have many recognized deficiencies including unevenly distributed force output, undue complexity, and sudden failure of shafting or gearing thereof so that the system becomes inoperable.

SUMMARY OF THE INVENTION

In view of the recognized deficiencies of conventional hydraulic actuators having synchronized motors, it is an object for this invention to provide a hydraulic actuation system which maintains precise synchronization of the motors.

Further, it is an object for this invention to provide such an actuation system wherein the maximum force exertable by any one motor in the event of a jam of the load member may be limited.

Another object is to provide a hydraulic actuation system for moving thrust reverser structure associated with a jet propulsion engine between deployed and stowed positions.

Still another object is to provide such a hydraulic actuation system wherein air is easily purged from the motors.

Another object is to provide such an actuation system which is self correcting should an asynchronous condition exist.

To this end, the invention provides, according to one preferred embodiment thereof, a hydraulic actuation system having multiple extensible motors of the double acting piston-in-cylinder type each having a pair of working volumes and a pair of synchronizing volumes. The synchronizing volumes of the motors are cross connected while the working volumes receive hydraulic pressure fluid according to the direction of actuation desired. A compensator device cooperates with the cross connected synchronizing volumes to ensure precise synchronization of the motors despite the inherent compressability of the hydraulic pressure fluid.

According to another embodiment of the invention, the hydraulic motors each define two volumes and the volumes of the multiple motors are connected in cascade fashion so that only one motor at either end of the cascade receives hydraulic pressure fluid from the source thereof dependent upon the direction of actuation desired. A pressure limiting valve device cooperates with each one of the hydraulic motors to limit the force which the motor may exert in the event that the load member becomes jammed.

DETAILED DESCRIPTION OF THE PREFERRED EMBODIMENTS

Figure 1:
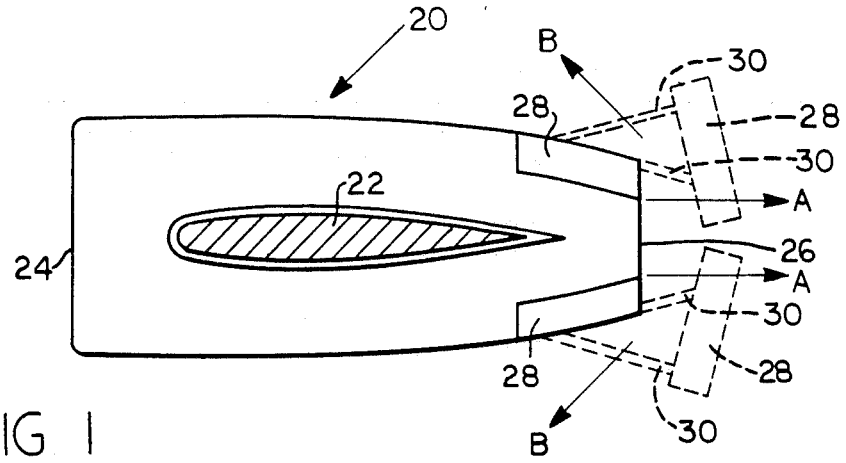
FIG. 1 illustrates an aircraft engine nacelle including thrust reverser structure depicted in stowed and deployed positions.

FIG. 1 illustrates an aircraft engine nacelle 20 which is coupled with the remainder of the aircraft (not shown) via a pylon 22. The nacelle 20 defines an inlet end 24 open in a forward direction to the atmosphere and leading to the inlet of a jet propulsion engine (not shown) which is housed within the nacelle. Opposite the inlet end 24, the nacelle 20 defines an open exhaust end 26 through which the engine exhaust flows rearwardly (as is represented by arrows A) to propel the aircraft in a forward direction. The nacelle 20 also carries a pair of thrust reverser components 28 which are illustrated in their stowed position by solid lines. In order to provide reverse thrust, the reverser components 28 are movable to a deployed position (illustrated by dashed lines) wherein they are supported by links 30 to deflect a major part of the engine exhaust flow as is illustrated by arrows B. The reverser components 28 are moved between their stowed and deployed positions by multiple actuators or motors (not visible in FIG. 1) housed within the nacelle 20 and coupling with the links 30.

Because the reverser components 28 are physically large, are somewhat flexible because they must be light in weight, and are subject to aerodynamic forces of great magnitude, care must be taken that the components 28 are not flexed, distorted or subjected to unevenly applied forces during their movement between the stowed and deployed positions.

Figure 2:
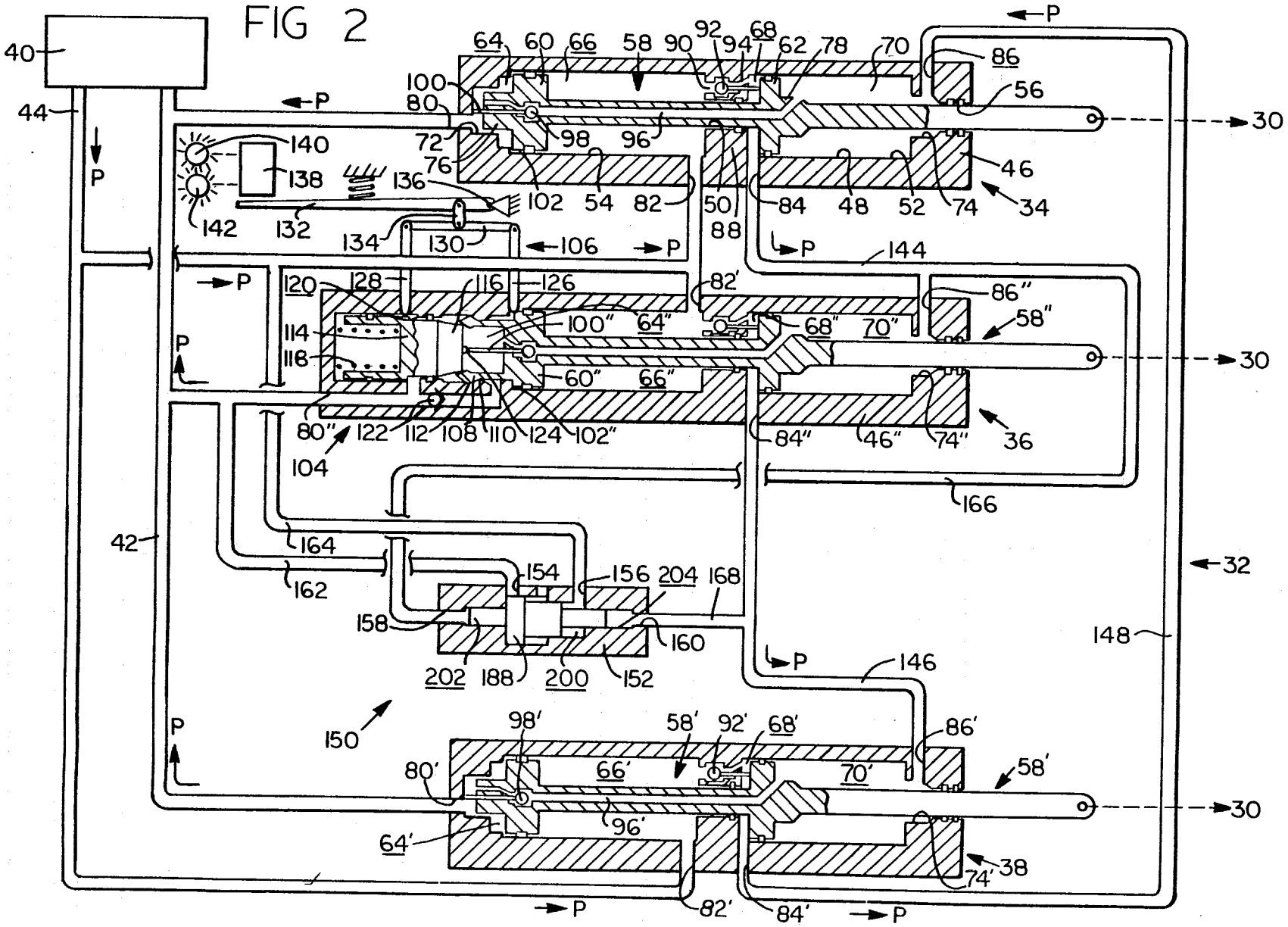
FIGS. 2 and 3 schematically depict a preferred embodiment of the invention in alternative operative conditions.
Figure 3:
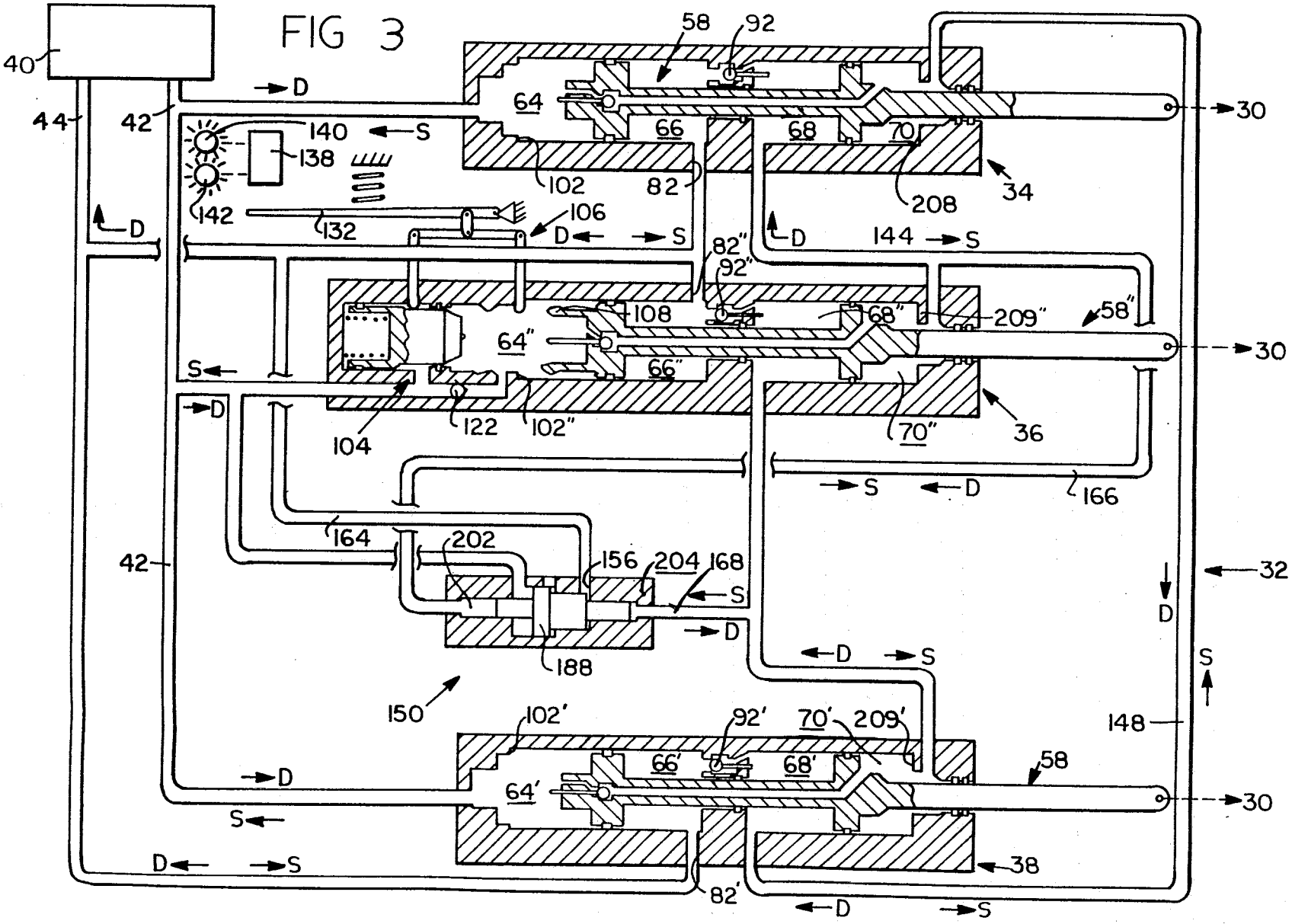

To this end, the invention provides an actuator 32, illustrated in FIGS. 2 and 3, and including three synchronized hydraulic motors 34–38. Each of the three motors 34–38 is coupled by structure (not illustrated but depicted by a dashed arrow) to a link 30 coupling with a single one of the thrust reverser components 28. Another identical actuator (not shown) is provided for moving the other of the pair of reverser components 28. A hydraulic pressure fluid source 40 is connected to each of the motors 34–38 via a pair of branched conduits 42 and 44. The source 40 is of conventional construction. To apply a stow command a supply of pressurized fluid is admitted to conduit 44 while accepting to a vented sump a returned lower pressure fluid flow via conduit 42. Alternatively, to apply a deploy command pressurized fluid is applied to ports 44 and 42 simultaneously.

The actuator 32 includes motors of two types. Because the motors 34 and 38 are identical, only the motor 34 will be described in detail, the equivalent features of motor 38 being referred to with the same reference numeral having a prime added. Hereinafter, use of a reference numeral without a prime added may be considered to include the feature referenced by that numeral and all analogous features referenced by that numeral with one or more primes added where such is appropriate in light of the context.

Motor 34 includes a housing 46 defining a stepped bore 48 therein. The bore 48 includes a reduced diameter portion 50 communicating between equal diameter bore portions 52 and 54 and a portion 56 equal in diameter to portion 50 and opening outwardly on the housing 46. A piston rod assembly 58 having a pair of piston heads 60 and 62 is reciprocably received in the bore 48 and sealingly cooperates with the housing 46 at the bore portions 50–56. Thus, the housing 46 and piston rod assembly 58 cooperate to define four variable-volume chambers 64–70. The housing 46 defines a pair of recesses 72, 74 with which a pair of pilot sections 76, 78 on the piston rod assembly 58 cooperate to define conventional velocity buffers. One of four ports 80–86 defined by the housing 46 opens respectively to each one of the chambers 64–70.

A partition portion 88 of the housing 46 defines the bore portion 50 and also defines a passage 90 communicating the chambers 66 and 68. A double acting, pressure responsive valve element 92 is movably received in the passage 90 and is sealingly engageable with the housing 46 to substantially prevent fluid flow through the passage 90 in both directions. A stem member 94 is movably received in the partition portion 88 and is engageable with the valve element 92 to prevent seating of the valve element so that fluid flow is permitted from chamber 66 to chamber 68 when the piston head 62 engages the stem member 94.

Similarly, the piston rod assembly 58 defines a passage 96 communicating chambers 64 and 70. A double acting, pressure responsive valve element 98 like the element 92 is disposed in the passage 96 within the piston head 60. The element 98 is engageable with piston head 60 to substantially prevent fluid flow in both directions through passage 96. A stem member 100 is movably received in the piston head 60. When the piston head 60 engages a shoulder 102 on the bore 48 to define a retracted position or stowed position of leftward movement for the piston rod assembly, the stem member 100 engages the valve element 98 and the housing 46 to permit fluid flow from chamber 70 to chamber 64.

Upon inspection of motor 36, it will be seen that a large portion of this motor is substantially identical to the motors 34 and 38. Consequently, the analogous features of motor 36 are referenced with the same numeral used previously and having a double prime added. In contrast to the motors 34 and 38, the motor 36 includes a pressure-responsive latch device 104 and a status indicator apparatus 106.

The latch device 104 includes an annular multitude of axially extending and radially flexible latch fingers 108 (only two of which are visible viewing the Figures) carried by the piston head 60″. The latch fingers are engageable with an annular locking shoulder 110 defined by the housing 46″. The latch fingers 108 and shoulder 110 cooperate to define oblique abutment surfaces at 112 so that the fingers 108 will deflect radially inwardly to disengage shoulder 110 in response to a relatively small rightwardly directed force on the piston rod assembly 58″.

However, the latch assembly 104 includes a stepped differential latch piston 114 movable in bore 48″ and having a tapered end 116 which is receivable within the annular array of latch fingers 108. The piston 114 is biased rightwardly by a spring 118 to engage the fingers 108 and prevent their disengagement from the shoulder 110. The piston 114 cooperates with the housing 46″ to define an annular chamber 120 communicating with port 80″. A check valve 122 prevents fluid flow from the port 80″ to chamber 64″ while permitting flow in the opposite direction. The latch piston 114 defines a protruding abutment member 124 engaging the stem member 100″ when the latch assembly is locked as illustrated.

The status indicator apparatus 106 includes a pair of movable pin members 126 and 128 which are each sealingly and movably received in the housing 46". The pins 126, 128 are biased inwardly and pivotally carry a toggle member 130 at their outer ends. The toggle member 130 is connected at its center to a flag member 132 via a pivotal link 134. The flag member 132 is pivotally mounted at 136 so as to move relative to a proximity switch 138 dependent upon the position of the pins 126, 128. The pins 126, 128 are respectively engageable by the piston head 60" and by latch piston 114 to move to an outward position when the piston head 60" engages shoulder 102" and when the latch piston 114 is locking the fingers 108 with shoulder 110. It will be apparent that the flag member 132 can occupy three positions dependent upon the positions of the pins 126, 128. With both pins in their outward stowed and locked position, as illustrated viewing FIG. 2, the flag 132 is in close proximity to switch 138. With the pins both in an inward position, viewing FIG. 3, the flag 132 is remote from switch 138. If only the pin 126 is outward but the latch piston 114 is not locking the fingers 110, the flag 132 is in an intermediate stowed position. The switch 138 is connected to binary sensory indicators such as lamps 140 and 142 which are lighted to indicate the "stowed" and "stowed and locked" positions, respectively, of the thrust reverser component 28.

In the actuator 32, conduit 42 connects to each port 80 of the motors 32–38. The conduit 44 connects to each port 82 of the motors 32–38. Conduits 144, 146 and 148, respectively connect ports 84 of motors 34, 36 and 38 to ports 86 of motors 36, 38, and 34.

A volume compensation device 150 includes a housing 152 defining ports 154–160. Conduits 162–168 respectively connect the ports 154–160 with conduits 42, 44, 144 and 146.

Figure 4:
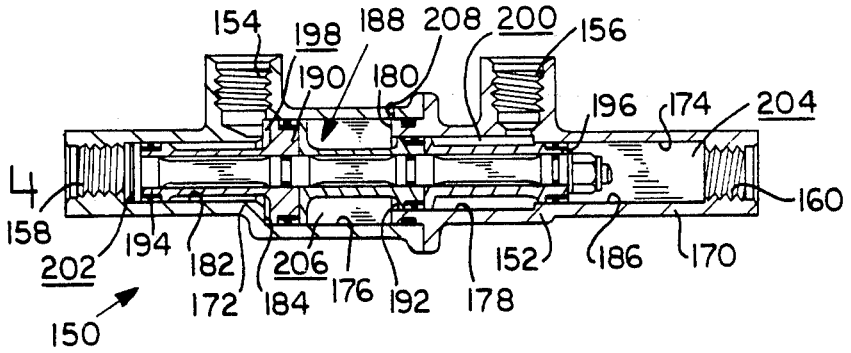
FIG. 4 illustrates a longitudinal cross sectional view of a volume compensation device which is also depicted schematically in FIGS. 2 and 3.

Turning now to FIG. 4, it will be seen that the housing 152 of volume compensation device 150 includes a first portion 170 and a second portion 172 which are sealingly joined together. The portions 170 and 172 cooperate to define an elongate stepped bore 174 opening outwardly on the housing 152 in the ports 158 and 160. The bore 174 includes large diameter and intermediate diameter central portions 176 and 178, respectively, cooperating to define a shoulder 180 therebetween. Bore portion 176 cooperates with a relatively smaller diameter bore end portion 182 to define a shoulder 184 therebetween. Similarly, the bore portion 178 communicates with a relatively smaller diameter bore end portion 186 like in diameter to portion 182 and leading to the port 160. The port 154 opens to the bore portion 176 adjacent the shoulder 184 while the port 156 opens on the bore portion 178.

A stepped plunger assembly 188 is reciprocably received in the bore 174. The plunger assembly 188 includes four axially spaced apart head portions 190–196 which sealingly cooperate with the bore portions 176, 178, 182, and 186, respectively. Thus, it is easily seen that the housing 152 and plunger 188 cooperate to define five variable volume chambers 198–206. The effective area of piston head 190 exposed to chamber 198 is greater than the differential effective areas of the piston head forming chamber 200. Chambers 202 and 204 are of equal effective area. The housing 152 defines a vent port 208 communicating chamber 206 with the atmosphere while the chambers 198–204 communicate with ports 154–160, respectively.

Having observed the structure of the actuator 32, attention may now be directed to its operation. When the component parts of the actuator 32 are in the relative operative positions illustrated in FIG. 2, the corresponding reverser component 28 is in its stowed position, as illustrated in solid lines viewing FIG. 1. The latching device 104 locks the motor 36 in its retracted position so that vibration and aerodynamic forces cannot dislodge the component 28 from its stowed position.

In order to prepare the actuator 32 for operation, the source 40 is arranged to supply pressurized fluid to conduit 44 and to receive to a vented sump returned low pressure fluid via conduit 42. Thus, pressurized fluid flows in the directions indicated by arrows 'P', viewing FIG. 2, and each of the chambers 66 receives pressurized fluid. The pressurized fluid in each chamber 66 insures that each of the piston heads 60 is engaging its corresponding shoulder 102 so that each of the motors 34–38 is fully retracted and prepared for synchronous motion in unision with the other motors. Because all of the valve elements 92 and 98 are unseated, fluid flows from the chambers 66 to the chambers 68 and hence to the chambers 70 of the cross-connected motors. From the chambers 70 fluid flows via the passages 96 to the chambers 64 and to the conduit 42 for return to the source 40. The fluid flow rate through the actuator 32 is controlled at a relatively low rate because the passages 90 and 96 cooperate with the valve elements 92 and 98 to form flow restrictions. Nevertheless, the fluid flow through the motors 34–38 is sufficient to purge substantially all air therefrom. Viewing the volume compensating device 150, it will be seen that the chamber 200 thereof communicates with conduit 44 to receive high pressure fluid so that the plunger assembly 188 is positioned leftwardly against shoulder 184.

In order to operate the actuator 32 in the deploy direction (rightwardly viewing FIGS. 2 and 3), the fluid source 40 is arranged to apply pressurized fluid to both conduits 42 and 44. Pressurized fluid enters chambers 64 of each of the motors 34 and 38. Thus, it is seen that the piston heads 60 of the motors 34 and 38 are exposed at both faces thereof to pressure fluid. However, the leftward faces of the pistons 60 define an effective area which is greater than the rightward face thereof because of the rod portions of the assemblies 58. Thus, the pressure fluid in chambers 64 urges the piston rod assemblies 58 of motors 34 and 38 rightwardly. The valves 98 prevent fluid flow from chambers 64 to chambers 70. Pressurized fluid also enters chamber 120 of motor 36. However, the check valve 122 prevents pressurized fluid from entering chamber 64". The spring rate and preload of spring 118 are selected in view of the effective area of latch piston 114 which is exposed to chamber 120 so that the latch device 104 does not unlock until the fluid pressure in the actuator 32 reaches a predetermined level. Examination of actuator 32 will show that when pressurized fluid is applied to both conduits 42 and 44, the valves 98 seat to prevent flow from chamber 64 to lower pressure chamber 70. On the other hand, pressurized fluid may flow from conduit 44 into each chamber 66, past the still unseated valve elements 92 to chambers 68, and finally from chambers 68 to chambers 70. Thus, any air or other gas entrained in the pressure fluid or trapped anywhere in the system is reduced in volume as the pressure within actuator 32 increases. Of course, the volume by which such air is reduced is filled with substantially incompressible liquid. Preferrably, the pressure within actuator 32 is increased to about one hundred (100) atmospheres before unlocking of latch device 104. Consequently, trapped air and other gases are reduced to about one-percent of their volume at atmospheric pressure. The result is that relatively small quantities of trapped or entrained gases do not significantly interfere with synchronized operation of the motors 34–38.

As soon as the latch 104 unlocks, the piston rod assemblies 58 of each motor 34–38 move rightwardly, viewing FIG. 3, to move the thrust reverser component 28 to its deployed position. Fluid flows in the actuator 32 are as indicated by arrows 'D', viewing FIG. 3. Initial rightward movement of the piston rod assemblies 58 allows the valve elements 92 to seat in response to prevailing liquid pressure differentials so that communication of fluid through passages 90 is prevented. Thus, the motors 34–38 are substantially locked into synchronization by fluid trapped in the communicating chambers 68 and 70 of each of the motors and in conduits 144–148. The motors 34 and 38 receive pressurized fluid from the source 40 to drive them rightwardly while the motor 36 is driven rightwardly by pressurized fluid in chamber 68″. Thus, it will be seen that during deploy operation of the actuator 32, the motor 36 is a slave to motor 38 and to motor 34, respectively. Because of the check valve 122, the chamber 64″ of motor 36 receives no pressurized fluid. Nevertheless, motor 36 is locked substantially into synchronous movement with motor 38 by fluid delivered to chamber 68″ from chamber 70′. Similarly, motor 38 must move in synchronism with motor 34 because of fluid delivered to chamber 68′ from chamber 70. Despite the fact that chamber 64″ receives no pressure fluid, the effective areas of chamber 64 and 64′ is sufficient to move the thrust reverser components 28 in the deploy direction. The components 28 require significantly less force for movement in the deploy direction than for movement in the stow direction.

Because the pressure fluid gives the appearance of not being absolutely incompressible, the motor 36 would lag slightly behind the motors 34 and 38 were it not for the operation of the volume compensating device 150. The device 150 receives pressure fluid from conduit 42 at port 154 so that the left face of piston head portion 190 (viewing FIG. 4) is exposed to pressure fluid while the right face is exposed to atmospheric pressure. Thus, the plunger 188 is driven rightwardly into engagement with shoulder 180 to displace fluid from the chamber 204 into conduit 146. Moreover, the chamber 204 serves as a storage location or reservoir of pressurized liquid. The device 150 receives an equivalent volume of fluid into chamber 202 so that the net fluid volume change effected by the device 150 is substantially zero. The fluid displaced from chamber 204 into conduit 146 has the effect of moving the piston rod assembly 58″ of motor 36 an additional increment to the right during the rightward stroke of the motor 36. In order to insure substantial synchronization of the motors 34–38, the volume displacement of chamber 204 is matched to the volume and effective compressibility of trapped fluid in chambers 70′ and 68″ and in conduits 146 and 168 so that the displacement volume of chamber 204 substantially matches the volume by which the trapped fluid is apparently compressed during operation of the actuator 32. Thus, the piston rod assemblies 58 of the motors 34–38 synchronously move rightwardly until the piston heads 62 of each engage corresponding shoulders 209 adjacent the recesses 74 when the thrust reverser component 28 reaches its deployed position.

It will be apparent in light of the above that should the actuator 10 be employed to move a load member requiring substantially the same force for movement in each direction, the check valve 122 may be omitted. Omission of check valve 122 results in each chamber 64 receiving pressurized fluid during deploy movement of the motors 34–38. Consequently, in such an appplication the motor 36 would not be a slave to the other two motors 34 and 38. That is, each of the motors 34, 36 and 38 would exert its appropriate share of the total exerted deploy force with fluid trapped in and transferred among the chambers 68 and 70 insuring synchronization of the motors. Because no one motor is a slave to any other motor in such an application, the volume compensating device 150 and associated plumbing would be unnecessary and would be omitted.

Returning once again to FIGS. 2 and 3, when it is desired to return the thrust reverser components to their stowed position, the fluid pressure source 40 is arranged to supply pressure fluid to conduit 44 and to once again receive returned fluid from conduit 42. That is, the fluid source is restored to the prepatory condition explained supra. Fluid flows are as indicated by arrows 'S' viewing FIG. 3. Each of the motors 34–38 receives pressure fluid at its port 82 to drive the motors leftwardly and to return the reverser component 28 to its stowed position. The volume compensation device 150 receives pressure fluid at port 156 to drive the plunger 188 leftwardly, refilling chamber 204 and displacing fluid from chamber 202. As the motor 36 approaches its stowed position, the fingers 108 force the latch piston 114 leftwardly and deflect radially inwardly in preparation to engage the shoulder 110. As soon as the fingers 108 spring radially outwardly to engage the shoulder 110, the piston 114 is moved rightwardly by spring 118 to engage the fingers 108 and lock motor 36 in its stowed position. The pins 126 and 128 cooperating with piston head 60″ and with latch piston 114, respectively, move the flag 132 to its "stowed and locked" position.

It is easily appreciated in light of the above that upon the completion of a "stow" actuation and prior to shut down of the fluid source 40, the actuator 32 is subjected to a self-purging, and self-sychronizing fluid flow as explained supra. Thus, the actuator 32 is subjected to a self-purging and self-synchronizing fluid flow prior to and following each deploy-stow operating cycle. Further, when the actuator 32 does have air trapped therein, for example, after initial installation or after maintenance, the air may be purged by applying a "stow" command to the actuator with the thrust reversers already in their stowed positions. Examination of FIG. 2 will reveal that the only dead end conduits of the actuator 32 are those leading to volume compensator 150. The compensator 150 is provided with conventional purge screws (not shown) which may be manually opened so that trapped air may be allowed to escape therefrom.

Figure 5:
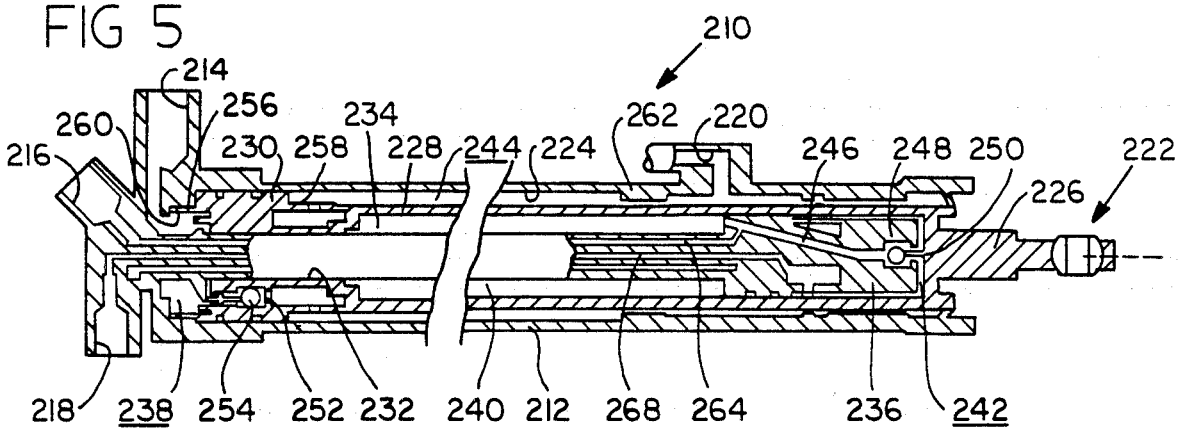
FIG. 5 illustrates a longitudinal cross sectional view of an alternative construction for two of the motors illustrated in FIGS. 2 and 3.
Figure 6:
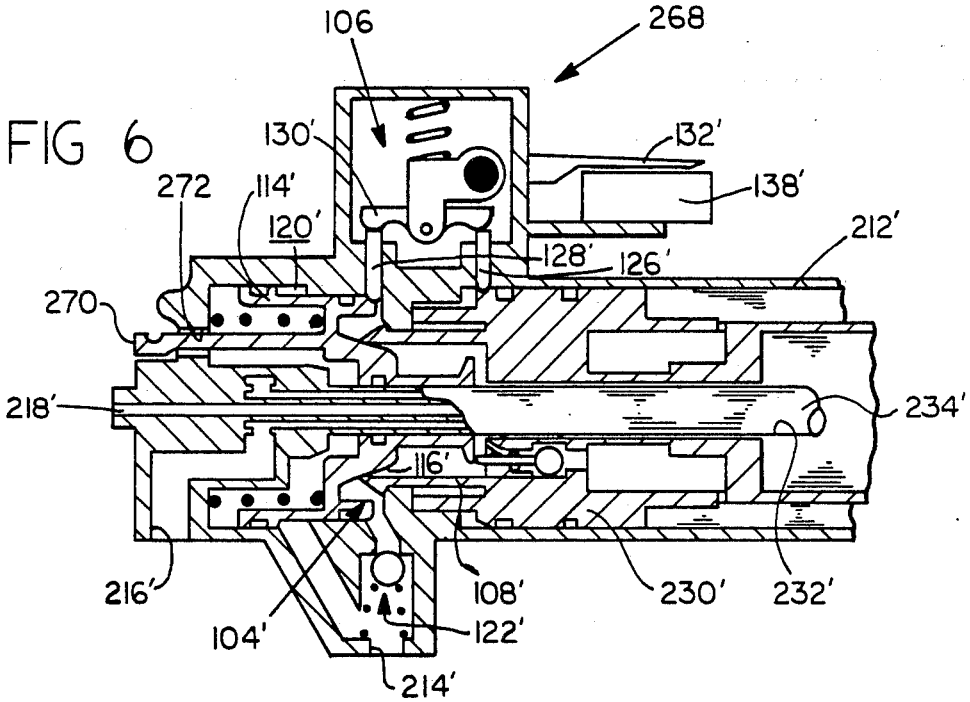
FIG. 6 illustrates a fragmentary longitudinal cross sectional view of an alternative construction for one of the motors illustrated in FIGS. 2 and 3.

Upon consideration of FIGS. 2 and 3, it will be apparent that the motors 34–38 must have an overall length more than twice as long as the total movement or stroke of their piston rod assemblies. In some applications, it is undesirable for the actuator motors to be so long in relation to their stroke. Accordingly, FIGS. 5 and 6 illustrate an alternative embodiment of the invention wherein motors 210 and 268 are analogous to the motors 34 and 36, respectively. The motors 210 and 268 are only slightly longer than the movement of the piston rod assemblies thereof.

The motor 210 illustrated in FIG. 5 includes a housing 212 defining ports 214–220 which are analogous to ports 80–84 of the preceding motor embodiment of FIGS. 2–4. A piston rod assembly 222 is reciprocably and sealingly received within a stepped bore 224 defined by the housing 212. The assembly 222 includes an end portion 226 and an annular rod portion 228 coupling with an annular piston head 230. The piston head 230 defines a stepped bore 232 opening to the interior of the annular rod portion 228. An elongated stem 234 is secured to the housing 212 and sealingly and movably passes through the bore 232. The stem 234 carries a partition member 236 which sealing and movably cooperates with the rod portion 228. In other words, the rod portion is reciprocably received over the immovable partition member 236 and stem 234. The housing 212 and assembly 222 cooperate with the stem 234 and partition member 236 to define four variable-volume chambers 238–244, which are analogous in function to the chambers 64–70, respectively, of the motors 34,38. It will be seen that chambers 240 and 244 are coannular. The partition member 230 defines a passage 246 receiving a double-acting valve element 248. Passage 246 and element 248 are analogous, respectively, to the features 90 and 92 supra. A projection 250 on the assembly 222 cooperates with the valve element 248 and is analogous to stem member 94 supra. Similarly, the piston head 230 defines a passage 252 receiving a double-acting valve element 254 analogous, respectively, to features 96 and 98 supra. The assembly 222 defines an annular collar 256 and an enlarged diameter portion 258 which respectively cooperate with a recess 260 and with a reduced diameter portion 262 of bore 224 to define velocity buffers similar to features 72–78 of the previous embodiment of FIGS. 2–4. The stem 234 defines coannular passages 264 and 268 communicating ports 216 and 218 respectively with chambers 240 and 242. It will be seen that chambers 240 and 242 communicate when valve element 248 is unseated, as do chambers 66 and 68 supra when the valve element 92 is unseated. In view of the above, it can be seen that the motor 210 is fully analogous functionally to the motors 34 and 38 while being only slightly longer overall than the movement of the piston rod assembly 222.

FIG. 6 illustrates a motor 268 similar in construction to the motor of FIG. 5 while being analogous in function to motor 36 of FIGS. 2 and 3. As before, features of FIG. 6 which are analogous to those of FIGS. 2 or 5 are referenced with the same numeral used previously and having a prime added. The motor 268 includes a latch device 104′ and a status indicator 106′. The latch piston 114′ of latch device 104′ is annular to sealingly circumscribe the stem 234′. Further, the latch piston 114′ includes a projection 270 extending externally of the housing 212′ through an aperture 272 defined on the latter. By manually moving the latch piston 114′ leftwardly by use of projection 270, the motor 268 may be unlocked as for maintenance purposes.

Figure 7:
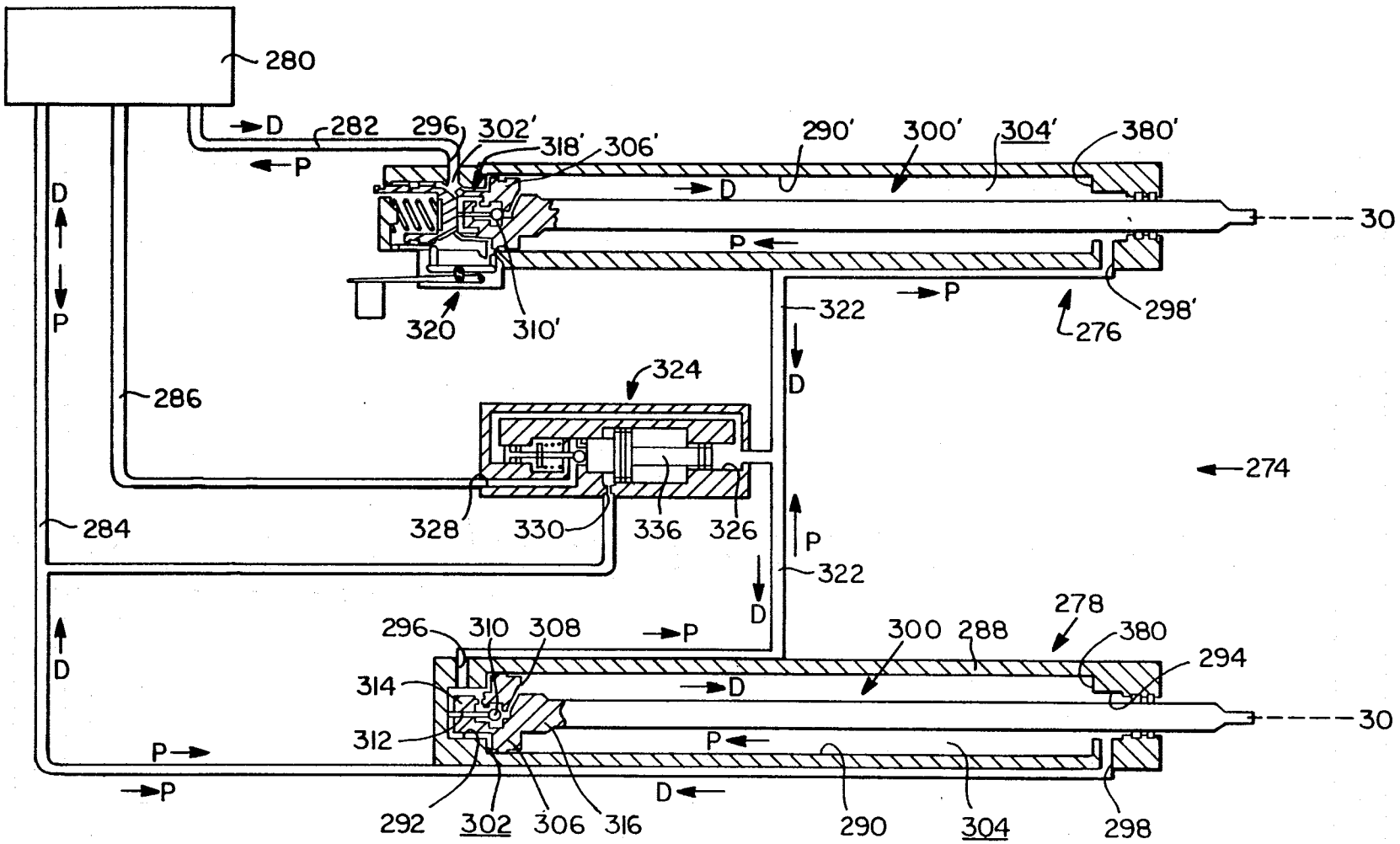
FIGS. 7 and 8 schematically illustrate yet another alternative embodiment for the invention.

FIG. 7 illustrates an alternative embodiment of the invention wherein an actuator 274 includes only two interconnected motors 276 and 278. However, as will become apparent in light of the following discussion, the actuator 274 could include a greater number of similarly connected motors. A hydraulic pressure fluid source 280 is connected to the motor 276 via a conduit 282 and to the motor 278 via a conduit 284. Similarly to the source 40 discussed supra, the fluid source 280 is arranged to communicate both conduits 282 and 284 so as to apply pressurized fluid thereto or, alternately, to apply pressurized fluid only to conduit 284 while receiving to a vented sump returned lower pressure fluid from conduit 282. However, the source 280 also provides a drain conduit 286 which is continously connected to the vented sump portion of the source 280 so that the conduit 286 is maintained always at ambient atmospheric pressure.

The motor 278 includes a housing 288 defining a stepped bore 290 having reduced diameter recesses 292 and 294 at opposite ends thereof. Ports 296 and 298 open respectively to the recesses 292 and 294. A piston rod assembly 300 is reciprocably and sealingly received in the bore 290. The piston rod assembly cooperates with the housing 288 to define a pair of varible-volume chambers 302 and 304. A piston head portion 306 of assembly 300 defines a passage 308 extending between chambers 302 and 304 and receiving a double acting valve element 310. A stem 312 cooperates with the valve element 310 as illustrated viewing FIG. 7 to allow fluid flow from chamber 304 to chamber 302 only when the motor 278 is in its stowed position. The assembly 300 includes pilot portions 314, 316 cooperable with recesses 292, 294 to define conventional veocity buffers.

The motor 276 is substantially similar to motor 278 with the exception that motor 276 includes a latch device 318 and a status indicator apparatus 320. Features of the motor 276 analogous to those of motor 278 are referenced with the same numeral having a prime added. Because the latch device 318 and status indicator 320 are analogous in structure and function to features 104 and 106, respectively, described supra, further explanation is deemed unnecessary. The effective diameters of bore 290′ and of piston rod assembly 300′ of motor 276 differ from those of the motor 278 so that the volume change of chamber 304′ matches the volume change of chamber 302 for equal movements of the piston rod assemblies 300 of both motors 276 and 278. That is, the bore 290′ is larger than bore 290. Thus, it is easily seen that the rightward face of piston head 306 of motor 278 defines an effective area which is smaller than the leftward face of piston head 306′ of motor 276.

The conduit 282 connects to port 296′ of motor 276 while conduit 284 connects to port 298 of motor 278. Port 298′ of motor 276 connects via a conduit 322 to port 296 of motor 278 so that upon operation of the actuator 274 in a direction to deploy the reverser component fluid will cascade from chamber 304′ to chamber 302. A volume compensation device 324 is connected to conduit 322 at a port 326. Device 324 also connects to conduit 286 at a port 328 and to conduit 284 at a port 330.

Figure 9:
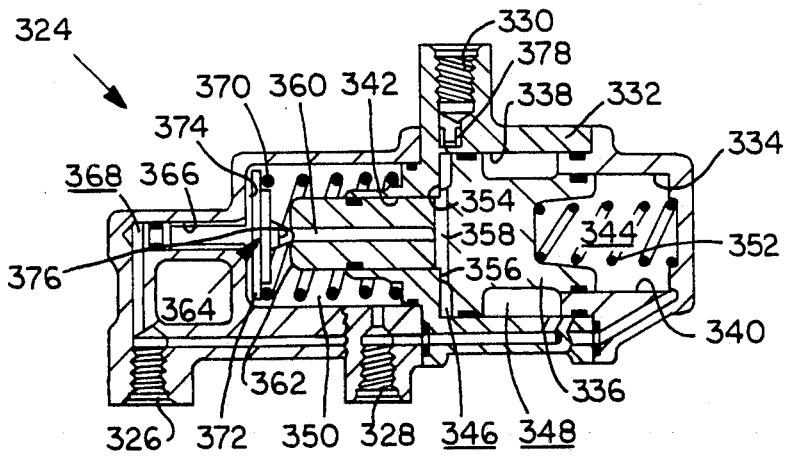
FIG. 9 illustrates a longitudinal cross sectional view of a volume compensation device which is also illustrated schematically in FIGS. 7 and 8.

Viewing FIG. 9, it will be seen that the volume compensation device 324 includes a multi-part housing 332, the parts of which are sealingly secured together. The parts of the housing 332 cooperate to define a substantially closed stepped bore 334 therein. A stepped plunger member 336 is reciprocably and sealingly received in portions 338, 340, and 342 of the bore 334; which portions are of progressively decreasing diameters as listed. The plunger member 336 and housing 332 cooperate to define four variable-volume chambers 344 and 346 (communicating respectively with ports 326 and 330), and 348, 350, both communicating with port 328. A coil spring 352 extends between the housing 332 and plunger member 336 to bias the latter leftwardly so that a shoulder 354 thereon engages a step 356 on bore 334. A transverse passage 358 leads from chamber 346 to an axially extending passage 360. The passage 360 opens to chamber 350 on a surface 362 of plunger member 336. A spring loaded pilot valve element 364 is sealingly received in a portion 366 of bore 334 and is movable in chamber 350. The element 364 cooperates with housing 332 to define a variable-volume chamber 368 communicating with port 326. A coil spring 370 extends between the housing 332 and a spring seat 372 on the valve element 364 to urge the latter into engagement with a step 374 on the bore 334. The valve element 364 includes a protrusion 376 sealingly cooperating with the surface 362 of plunger member 336 at the opening of passage 360.

Figure 8:
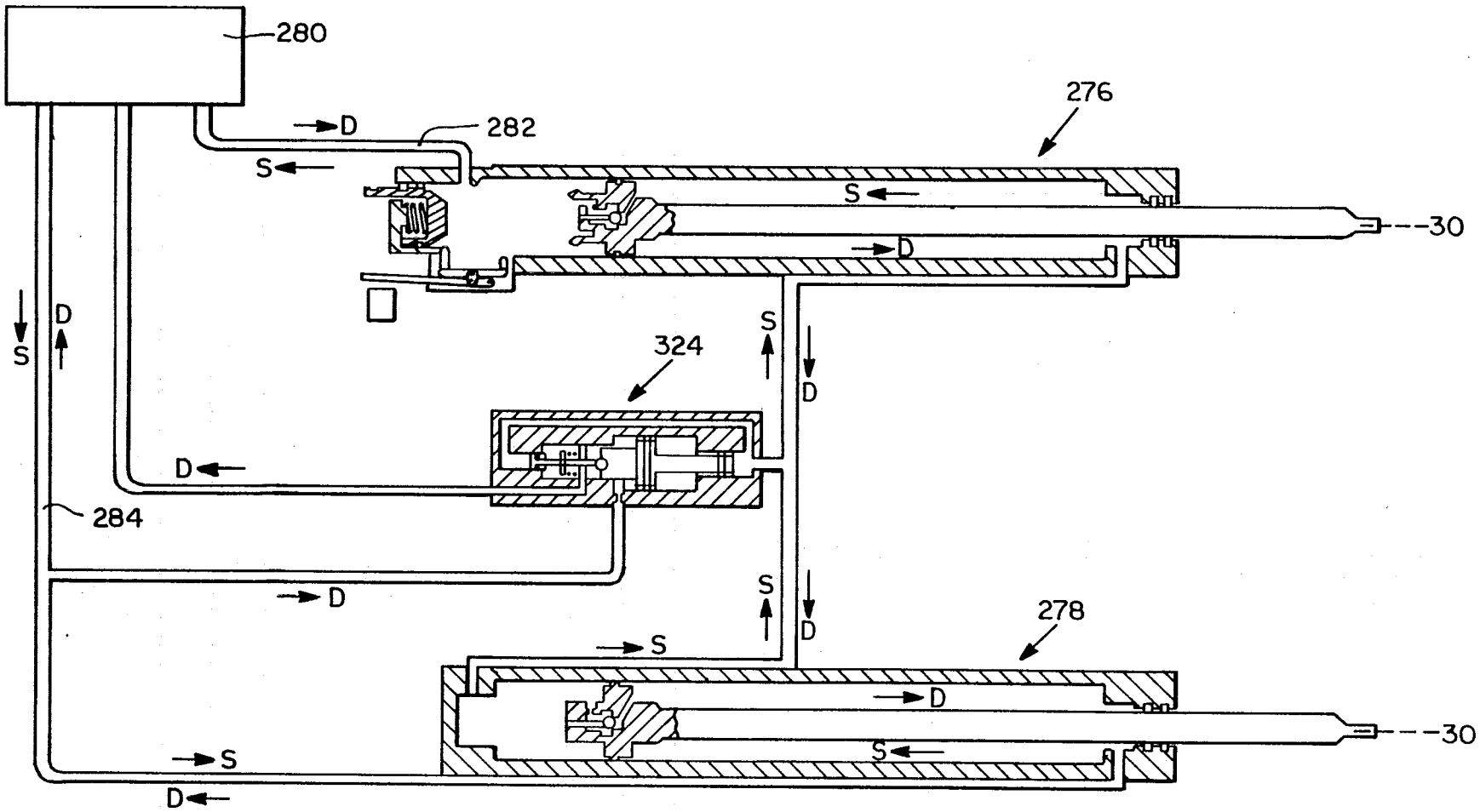

Turning again to FIG. 7, in order to prepare the actuator 274 for operation in the deploy direction, the source 280 is arranged to supply pressure fluid to conduit 284 and to receive returned fluid from conduit 282. Thus, fluid flows are as indicated by arrows 'P' and the motors 276, 278 are purged of air and synchronized in preparation for a deploy operation. In order to deploy the thrust reverser component, source 280 is arranged to apply pressurized fluid to both conduits 282 and 284. When pressurized fluid is received in chamber 302' of motor 276, the valve element 310' seats to prevent flow of pressure fluid to chamber 304'. The latch device 318 locks the piston rod assembly 300' until a sufficient fluid pressure is attained within actuator 274 to compress any trapped and entrained air in the system, as explained above with regard to FIGS. 2 and 3. That is, such fluid may flow into the actuator via conduit 284. As soon as the latch device unlocks, the piston rod assembly 300' moves rightwardly cascading fluid from chamber 304' to chamber 302 via conduit 322. Therefore, the valve element 310 seats to hydraulically lock the motors 276, 278 substantially in sychronization. Turning to FIG. 8, the piston rod assemblies 300 move rightwardly to deploy the thrust reverser component until the head portions 306 engage a shoulder 380 of housings 288 to define a deployed position. Fluid flows are depicted by arrows 'D'.

However, the pressure fluid in the actuator 274 has an effective compressibility as explained supra. Apparent compression of the fluid in chambers 304' and 302 and in conduit 322 would cause the motor 278 to lag behind the motor 276. In order to prevent the motor 278 from so lagging, the compensation device 324 senses the pressure in the conduit 322 at port 326 (viewing FIG. 9). The sensed pressure moves the pilot valve element 364 rightwardly in opposition to spring 370. The device 324 also receives pressure fluid at port 330 which urges the plunger member 336 rightwardly in opposition to fluid pressure in chamber 344 to decrease the volume of the latter and displace fluid therefrom into conduit 322. Thus, rightward movement of plunger member 336 decreases lagging of the motor 278 to maintain synchronizm of the motors 276,278. However, the fluid pressure in chamber 346 is controlled by the combination of a flow restrictive orifice 378 at port 330 and the throttling effect of the protrusion 376 of pilot valve element 364 at the opening of passage 360. In view of the above, it is easily seen that the plunger member 336 moves rightwardly ahead of the pilot valve element 364 and that the latter moves rightwardly in opposition to spring 370 in proportion to the fluid pressure in conduit 322. Accordingly, the device 324 supplies fluid volume to conduit 322 in proportion to the fluid pressure therein. Therefore, the device 324 supplies fluid volume in proportion to the pressure applied to, and compression of, the trapped fluid in the motors 276, 278 to maintain synchronized movement of the motors.

In order to stow the thrust reverser component, the source 280 is arranged to supply pressure fluid to conduit 284 and to receive returned fluid from conduit 282. Thus, fluid flows in the actuator 274 are as indicated by arrows 'S' viewing FIG. 8, and the motors 276, 278 are driven to the stowed position illustrated in FIG. 7. It will be noted that the fluid flow to effect stowing of the reverser components is identical with that for purging of the actuator 274. Upon the motors reaching the stowed position and prior to shut down of the fluid source 280, the motors are subjected to a self-purging and self-synchronizing fluid flow.

Figure 10:
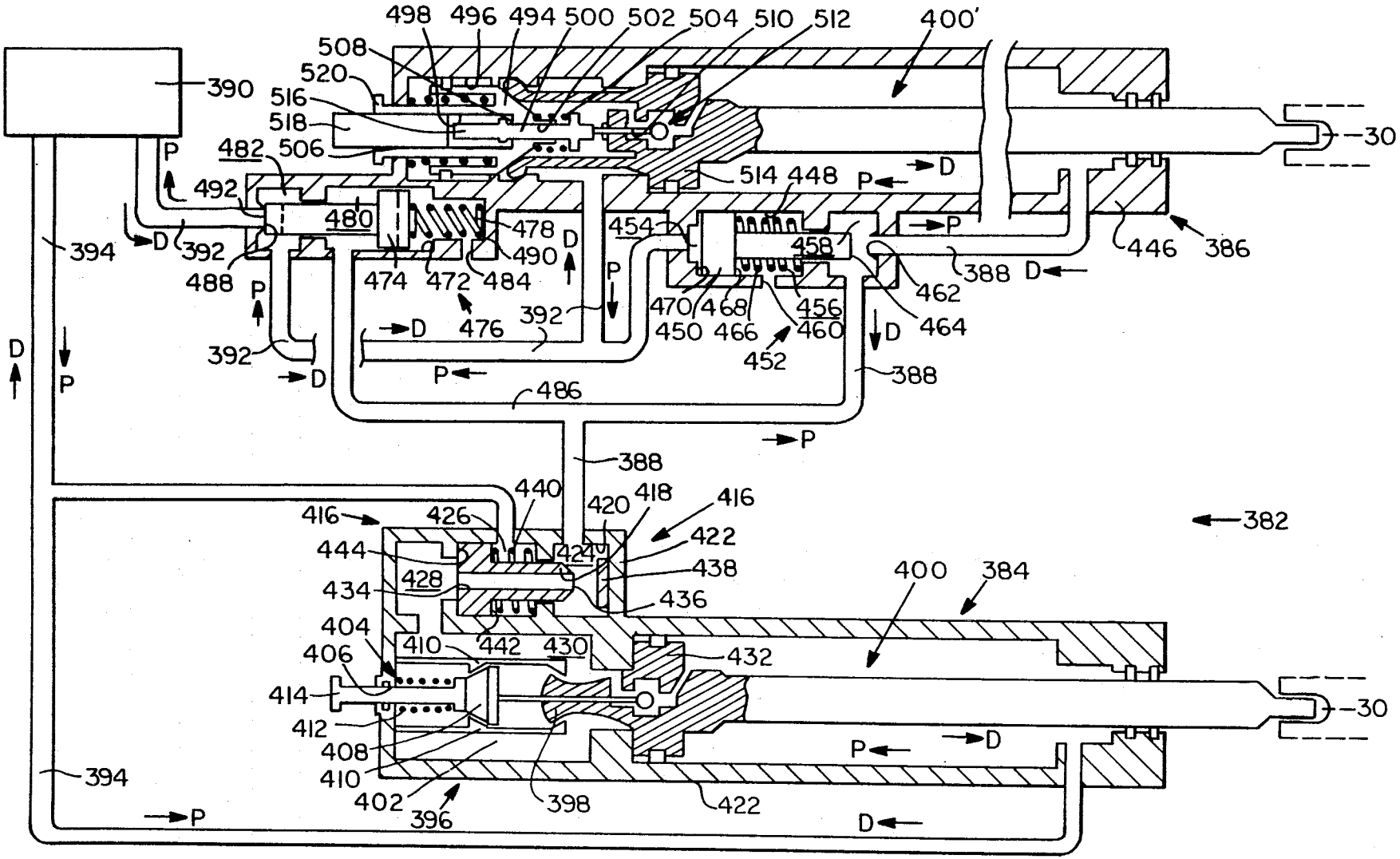
FIG. 10 schematically illustrates still another alternative embodiment of the invention.

FIG. 10 illustrates yet another alternative embodiment of the invention wherein an actuator 382 includes motors 384 and 386 which are connected so as to cascade fluid therebetween via a conduit 388; and which are also connected to a pressure fluid source 390 by conduits 392, 394. Viewing FIG. 10, it is easily perceived that the structure, function, and operation of the motors 384, 386 are substantially similar to that of the motors 276, 278 illustrated in FIGS. 7 and 8. Therefore, only distinctive features of the embodiment illustrated in FIG. 10 will be explained infra.

The motor 384 includes a detent assembly 396 which comprises an elongate bulbous protrusion 398 carried by a piston rod assembly 400 of the motor. The protrusion 398 is receivable within an annularly arranged multitude of resilient detent fingers 402 (only two of which are visible viewing the Figures). The protrusion 398 and fingers 402 are arranged with inclined engaging surfaces to cooperate so that they will engage and disengage in response to predetermined axial forces. Thus, the detent assembly assists in retaining the motor 384 and associated reverser component in the stowed position. A release member 404 is movingly and sealingly received in an aperature 406 on the motor 384. The release member 404 includes a conical head portion 408 which cooperates with wedge-shaped sections 410 of the fingers 402 to move the latter radially outwardly in response to leftward movement of the release member 404. A coil spring 412 biases the release member 404 rightwardly so that the release member does not normally influence operation of the detent assembly 396. The release member 404 includes a knob portion 414 by which it may be manually moved leftwardly to release the piston rod assembly 400, as for maintenance purposes.

The motor 384 also includes a deploy force limiting valve device 416 comprising an annular stepped valve element 418 movingly and sealingly received in a stepped bore 420. The valve element 418 cooperates with a housing 422 of motor 384 to define three chambers 424–428. Chambers 424 and 426 communicate respec-tively with conduits 388 and 394 while chamber 428 communicates with a working chamber 430 of motor 384 leftwardly of a piston head portion 432 of piston rod assembly 400. A passage 434 in the element 418 communicates chambers 424 and 428 and opens right-wardly on the valve element in a valving edge 436. The valving edge 436 confronts and is sealingly cooperable with a seat member 438 carried by housing 422. A coil spring 440 extends between housing 422 and a shoulder 442 on valve element 418 to urge the latter into engagement with a step 444 on bore 420.

A housing 446 of motor 386 defines a stepped bore 448 movingly and sealingly receiving a stepped plunger member 450 cooperating with the housing to define a deploy force limiting valve device 452. The housing 446 and plunger 450 cooperate to define three chambers 454–458. Chamber 454 communicates with conduit 392 while chamber 456 communicates with the atmosphere via a vent port 460. Chamber 458 is interposed in the conduit 388 to define a part of the fluid flow path therethrough. The housing 446 defines an annular valving edge 462 confronting an end surface 464 of the plunger member 450. A coil spring 466 extends between the housing 446 and a shoulder 468 on plunger member 450 to bias the latter into engagement with a step 470 on the bore 448.

The housing 446 further defines a stepped bore 472 sealingly and movingly receiving a stepped plunger member 474 cooperating with the housing to define a sequence interlock valve device 476. The housing 446 and plunger member 474 cooperate to define three chambers 478–482. Chamber 478 communicates with the atmosphere via a vent passage 484 while chamber 480 communicates with conduit 388 via a conduit 486. Chamber 482 is interposed in the conduit 392 to define a part of the fluid flow path therethrough. Housing 446 defines an annular valving edge 488. A coil spring 490 extends between the housing 446 and the plunger member 474 to urge an end surface 492 thereof into sealing engagement with the valving edge 488.

Further examination of FIG. 10 will reveal that the motor 386 comprises a latch piston 494 movingly and sealingly received in a bore portion 496 of the housing 446. The piston 494 defines a stepped bore 498 extending therethrough. A stem member 500 is sealingly and movingly received on a small diameter portion 502 of the bore 498. A coil spring 504 biases the stem member 500 rightwardly so that a shoulder 506 thereon as engageable with a step 508 on the bore 498. The stem member 500 is cooperable at its right end with a push rod 510 of a double acting valve device 512 in a piston head 514 of the piston rod assembly 400' of the motor 386. At its left end, the stem member 500 defines an elongate "flag" portion 516 moveable relatively rightwardly from the "locked" position illustrated to an "unlocked" position in response to leftward movement of the latch piston 494. A proximity sensor 518 is received in the left end of bore 498 and is responsive to movement of the flag portion 416 between the locked and unlocked positions thereof to cause a binary sensory signal via other structure (not shown). The latch piston 494 includes a knob portion 520 external of the motor 386 by which the latch piston may be manually moved to its unlocked position, as for maintenance purposes.

When the fluid source 390 is arranged to supply pressure fluid to conduit 394 and receive returned low pressure fluid via conduit 392, the motors 384, 386 are purged of air and synchronized preparatory to a deploy operation by fluid flows as indicated by arrows 'P' viewing FIG. 10. It will be noted that the plunger 474 of valve device 476 is moved rightwardly to an open position (illustrated by dashed lines) by fluid pressure in chamber 480. That is, the pressure drop caused by double acting valve 512 of motor 386 is sufficient to shift plunger 474 rightwardly. This fluid pressure reaches chamber 480 via the motor 384, valve device 416, conduit 388, and conduit 486. While the pressure level reaching chamber 480 is less than that supplied by the source 390 because of the pressure drop caused by the double acting valve in motor 384, the spring rate and preload of spring 490 are matched to the effective area of plunger 474 exposed to chamber 480 so that the valve device 476 is open during preparatory fluid flow conditions.

In order to operate the motors 384, 386 in the deploy direction, the source 390 is arranged to apply pressure fluid to both conduits 392 and 394. Fluid flows are indicated by arrows 'D' viewing FIG. 10. During the deploy operation of the motors 384, 386, should the force exerted by motor 384 reach a predetermined maximum, the fluid pressure differential between conduits 388 and 394 reaches a predetermined maximum. Consequently, the fluid pressure differential between chambers 426 and 428 moves the valve element 418 rightwardly to engage the valving edge 436 thereof with the seat member 438. Therefore, rightward motion of motor 384 is stopped and fluid trapped in the motor 386 rightward of piston head 514 stops the movement of motor 386.

Similarly, should the force exerted by motor 386 reach a predetermined maximum, the plunger 450 of valve device 452 moves rightwardly in response to the pressure differential across piston head 514 as manifest in chambers 454 and 458 to engage surface 464 with valve edge 462. Thus, the movement of motor 386 is stopped which stops the cascade of fluid via conduit 388 to motor 384 and stops the movement of the latter.

To stow the thrust reverser component, the source 390 is is once again arranged to receive fluid from conduit 392 and to supply pressure fluid to conduit 394. Thus, the piston rod assemblies 400 of motors 384, 386 are driven leftwardly to the position illustrated in FIG. 10. Liquid flow is, therefore, identical with that indicated by arrows 'P'. If a jam or unusual resistance to movement in the stow direction should cause the motor 384 to stop or lag behind motor 386 during the stow operation, aerodynamic forces acting on the reverser component, or other forces, may cause a leftwardly directed force on the piston rod 400' of motor 386. Such a force acting on motor 386 would result in continued leftward movement of piston rod 400' ahead of piston rod 400 of motor 344 and loss of synchronization of the motors. However, when the motor 384 stops, the fluid pressure in conduit 388 decreases so that the plunger 474 of sequence interlock valve 476 is moved leftwardly by spring 490 to seat at surface 492 on valving edge 488. Consequently, fluid is trapped leftwardly of the piston head 514 of motor 386 to stop leftward motion thereof or to momentarily retard such motion until the motors once again are synchronized.

Figure 11:
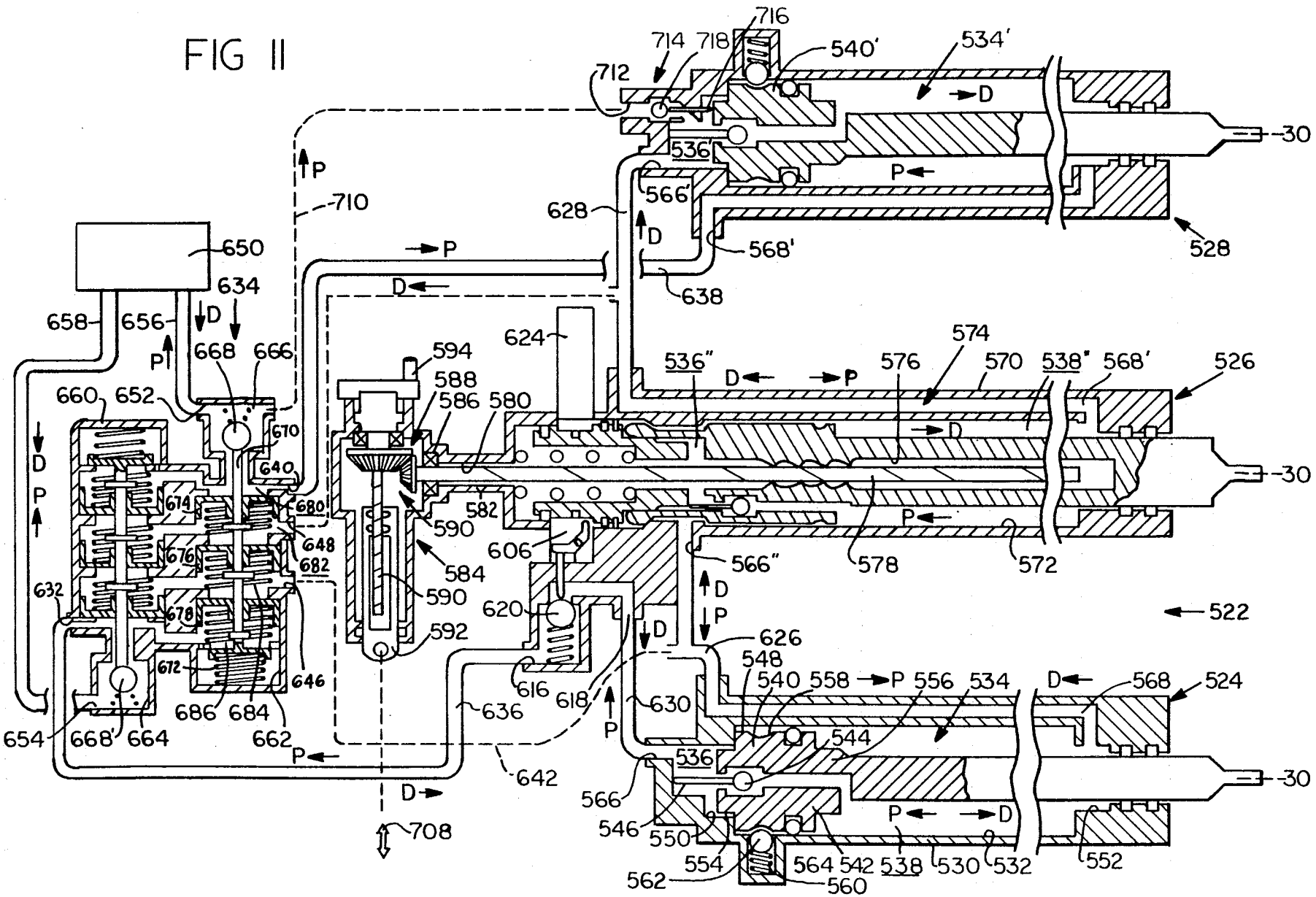
FIG. 11 schematically illustrates another alternative embodiment of the invention.

FIG. 11 illustrates another embodiment of the invention wherein an actuator 522 includes three motors 524–528. Motors 524 and 528 are substantially similar except for piston head and rod diameters so that only the motor 524 will be explained in detail; analogous features of motor 528 having the same reference numeral with a prime added.

Motor 524 includes a housing 530 defining a stepped bore 532 therein. A piston rod assembly 534 is sealingly and reciprocably received in the bore 532 and cooperates with housing 530 to define chambers 536, 538. A piston head portion 540 of the assembly 534 defines a passage 542 communicating chambers 536 and 538. A double acting valve element 544 is movably received in passage 542 to prevent fluid flow therethrough in both directions. A stem member 546 is also movably carried in the piston head 540 and is cooperable with the valve element 544 when the piston head 540 engages a step 548 on bore 532 to allow fluid flow from chamber 538 to chamber 536. The housing 530 defines recesses 550, 552 at opposite ends thereof which are cooperable with pilot portions 554, 556 on assembly 534 to define conventional velocity buffers. An annular groove 558 circumscribes the piston head 540. The housing 530 defines a radially extending cavity 560 aligning with the groove 558 when the piston head 540 engages step 548. A ball detent member 562 is captured in the cavity 560 along with a spring 564 urging the ball radially inwardly into the groove 558. The housing 530 defines ports 566, 568 communicating respectively with chambers 536, 538.

The motor 526 includes a housing 570 defining a stepped bore 572 therein. A piston rod assembly 574 is sealingly and reciprocably received in the bore 572. As with the motors 524 and 528, the motor 526 includes structure defining conventional velocity buffers. However, the piston rod assembly 574 also defines an axially extending bore 576 therein. A jack screw 578 having a reltively low helix angle relative to the axis thereof is rotatably received in the bore 576 and in an aligning bore 580 defined by an extension 582 of housing 570. The jack screw 578 threadably engages piston rod assembly 574. The extension 582 leads to a gear case 584 carrying a rotatable bearing 586 which radially and axially locates the jack screw 578. A set of meshing bevel gears 588 are received in the gear case 584, one gear being mounted to jack screw 578 and the other compling with a relatively short jack screw 590 having a helix angle determined by the ratio of the gear set 588 and the comparative lengths of the screws 590 and 578. A position feed back member 592 is threadably received on the jack screw 590 and sealingly extends outwardly of the case 584 for axial motion relative thereto while being prevented from rotary motion, as by a key and keyway (not shown). The other bevel gear of set 588 also couples with a crank handle 594 extending externally of the case 584.

A latch device 596 of motor 526 includes an annularly arrayed multitude of fingers 598 (only two of which are illustrated) engageable with a shoulder 600 of the housing 570. A stepped pressure responsive latch piston 602 is cooperable with the fingers 598 and is sealingly and movably received in the bore 572. A coil spring 604 biases the latch piston 602 rightwardly, viewing FIG. 11. The housing 570 defines a cavity 606 opening to the bore 572. Latch piston 602 sealingly cooperates with the housing 570 at both sides of the opening of cavity 606; and defines a larger sealing diameter rightwardly of the opening than leftwardly of the opening. An L-shaped toggle member 608 is pivotally carried in cavity 606 and one leg of the toggle member engages the latch piston 602 at a shoulder 610 thereon. The other leg of the toggle member 608 movingly engages a stem member 612 which is sealingly and movingly carried by the housing 570. A passage 614 defined by housing 570 opens in ports 616, 618. A valve element 620 is received in passage 614 and is spring loaded toward sealing engagement with housing 570 to prevent flow from port 616 to port 618. The stem member 612 when moved downwardly is engageable with valve element 620 to unseat the latter.

The latch piston 602 carries an annular "target" 622, while the housing 570 carries a proximity sensor 624 having a zone of response oriented perpendicularly to the direction of possible axial movement of piston 602. When the latch piston 602 is locking the fingers 598 (as illustrated) the piston 602 is located in a unique position with target 622 in alignment with the sensor 624. The sensor 624 has a zone of response subtending a small angle so that it has a rather narrow "field of view". As a result, when the piston 602 is moved leftwardly by fluid pressure in chamber 536", the sensor 624 does not "see" the target. On the other hand, if the piston rod assembly 574 is rightward of its illustrated stowed position and the piston 602 is not held to the left by fluid pressure in chamber 536", the spring 604 moves the piston 602 rightwardly of the locking position so that once again the sensor 624 does not "see" the target 622. The sensor 624 is associated with structure (not shown) to produce a binary sensory signal.

The motors 524–528 are connected to cascade fluid therebetween. That is, a conduit 626 connects port 568 of motor 524 to port 566" of motor 526. A conduit 628 connects port 568" of motor 526 with port 566' of motor 528. The effective areas of the piston rod assemblies 534, 534', and 574 are arranged to produce synchronized movement thereof as explained previously hereinabove. A conduit 630 connects port 566 with port 618 while port 616 is connected to a port 632 of a valve device 634 by a conduit 636. A conduit 638 connects port 568' of motor 528 with a port 640 of device 634. Conduits 642 and 644 (illustrated in dashed lines) communicate conduits 626 and 628 respectively with ports 646 and 648 of device 634. A fluid pressure source 650 is connected to ports 652, 654 of device 634 via conduits 656 and 658.

With more particular attention to the valve device 634, because the left and right portions of device 634 are substantially identical with the portions substantially being reversed mirror images of one another, only the right portion will be described in detail; analogous features of the left portion being referenced with the same numeral having a prime added. A housing 660 of the devise 634 defines a pair of stepped bores 662,664. At its upper end, the bore 662 defines a valve chamber 666 having a valve element 668 therein. The element 668 is sealingly engageable with housing 660 to prevent fluid flow from port 652 to port 640. A stem member 670 is reciprocably received in bore 662 and is biased upwardly by a spring 672 to engage and unseat the valve element 668 to a normally open position. Three annular piston members 674–678 are sealingly and reciprocably received in the bore 662 and on the stem member 670. The piston members 674–678 cooperate with stem member 670 and with housing 660 to define four chambers 680–686. Ports 640, 648, and 646 open respectively to chambers 680, 682, and 684. Chamber 686 communicates with chamber 680' via a passage 688. Three passages 690–694 respectively communicate chamber 684 with 682', 682 with 684', and 680 with 686'. Respective coil springs 696–700 extend between the housing 660 and the piston members 674–678 to urge the latter upwardly. The stem member 670 defines three outwardly extending flanges 702–706 respectively engageable by piston members 674–678 upon downward movement thereof.

In order to prepare the actuator 522 for operation, the pressure source 650 is arranged to supply pressure fluid to conduit 656 and to accept returned fluid via conduit 658. The pressure fluid flows past the normally open valve element 668 of device 634. Consequently, fluid flows are as depicted by arrows 'P' to purge the actuator of air and to synchronize the motors 524–528. In the motor 526, the fluid flows from port 618 to port 616. The valve element 620 acts as a relief valve to allow fluid flow to conduit 636 and to maintain a predetermined pressure upstream of the element 620. The valve element 620 in combination with the flow restricting valve element 544 in the piston rod assembly 534 insures that sufficient pressure is developed in chamber 536" of motor 526 to move latch piston 602 leftwardly if no substantial amount of air is trapped in the actuator 522. Thus, the valve element 620 is unseated by stem member 612. However, if substantially all air has not been purged from the actuator, the piston 602 remains in its locked position because air flows rather easily through the various flow restrictions so that sufficient pressure is not developed to move latch piston 602 leftwardly. The valve element 620 consequently may remain seated to prevent fluid flow from port 616 to port 618.

Further to the above, it will be appreciated that if one or more of the motors 524, 526 and 528 contains a substantial quantity of air, which flows rather easily and without substantial pressure drop through the various flow restrictions of the actuator, a substantial pressure differential may be developed within the actuator as air is purged by pressurized liquid. That is, a substantial temporary pressure differential may be realized between a liquid filled portion of the actuator and a portion which is yet air filled. Because the force limiting valve device 634 is responsive to pressure differentials within actuator 522 to stop liquid flow thereto in both directions, it is possible that the valve element 668 of device 634 may be seated during purging of the actuator 522. The result of seating of valve element 668 would be a temporary interruption of purging liquid flow while pressures within the actuator moved toward equilibrium. While such an interruption would be momentary, it could be repeated during purging so that a delay could be experienced in achieving purging of air from the actuator.

In order to prevent such interruptions to purging of air from the actuator 522, the valve device 634 defines a port 708 which communicates with conduit 656 upstream of valve element 668. A conduit 710 extends from port 708 to a port 712 defined by a double acting valve device 714. The valve device 714 includes a stem member 716 which insures that a valve element 718 of the device 714 cannot seat to prevent flow from conduit 710 into chamber 536' when the piston rod assembly 534' is in its stowed position. That is, when piston rod assembly 534' is in its stowed position, liquid may flow from conduit 710 into chamber 536'. Thus, even should the valve element 668 be seated during purging of the actuator 522, purging flow will continue uninterrupted via chamber 666, port 708, conduit 710, port 712, and valve device 714. During deploy and stow operations of the motor 528, the valve device 714 prevents flow in both directions through conduit 710. Consequently, the valve device 714 does not interfere with synchronous operation of the motors 524, 526, and 528.

To deploy the thrust reverser component, the source 650 is arranged to supply pressure fluid to both conduits 656, 658. If the valve element 620 has not been unseated by stem member 612, fluid cannot flow in conduit 658. However, fluid does flow toward the actuator in conduit 656 to build up fluid pressure therein and compress air trapped therein. When the fluid pressure in chamber 536" of motor 526 reaches about one hundred atmospheres, the latch piston 602 moves leftwardly to unlock fingers 598 and to unseat valve element 620.

As soon as the valve element 620 unseats, fluid flows as depicted by arrows 'D' to extend the motors 524–528. Rightward movement of the piston rod assembly 524 of motor 526 causes rotation of jack screw 578. The connection of piston rod assembly 574 to the reverser component prevents the assembly 574 from rotating. Thus, the jack screw 578 rotatably drives screw 590 via gears 588 to translate position feed back member 592. The member 592 is connected by structure (not shown) to an analog position indicator (depicted by arrow 702) in the aircraft cockpit to supplement the binary signal from proximity sensor 624.

Should a jam affect one of the motors 524–528 during the deploy operation, the fluid pressure differential across the associated motor piston head will reach a predetermined maximum. This pressure differential also appears in the associated chambers of the left hand portion of device 634. The one of piston members 674'–678' exposed to the predetermined maximum pressure differential shifts upward away from valve element 668' to retract stem member 670' and allow the element 668' to seat. Thus, movement of the motors 524–528 in the deploy direction may be stopped.

To stow the reverser component, the source 650 is arranged to supply pressure fluid to conduit 656 and to accept returned fluid via conduit 658. Liquid flow is as indicated by arrows 'P', viewing FIG. 11. If during the stow operation, a jam affects any of the motors 524–528, the right hand portion of device 634 operates to stop the stow operation. Because the right and left hand portions of device 634 operate independently to respectively limit the maximum force that any one motor may exert during the stow and deploy operations, different force levels may be exerted by each motor 524, 526 and 528 during the stow and deploy operations. Thus, aerodynamic forces on the reverser component may easily be accommodated while still protecting the reverser component from damage which would be caused if excessive force were exerted by one or more motors during a jam.

At the completion of a stow operation and prior to shut down of the fluid source 650, the actuator 522 is subjected to an air purging and synchronizing fluid flow, which is the same as the 'P' preparatory flow described above.

Figure 12:
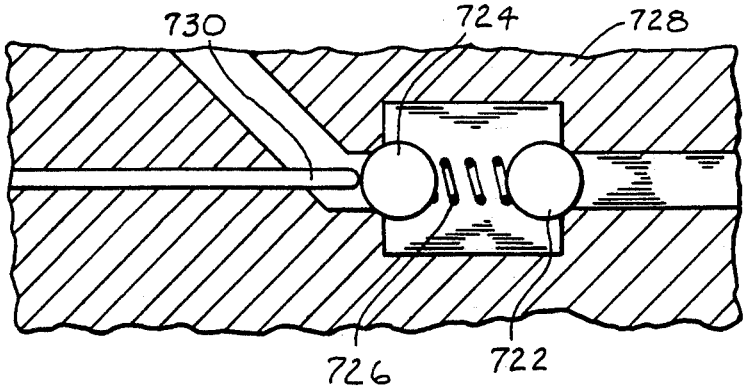
FIG. 12 illustrates an alternative construction of a double acting valve device of the invention.

While this invention has been depicted and described by reference to selected preferred embodiments thereof, it will be apparent that the features of the various embodiments may be combined differently. For example, the volume compensating devices of FIGS. 4 and 9 may be employed in conjunction with the embodiments of FIGS. 10 and 11. Similarly, the force limiting valve device 634 of FIG. 11 may be employed in the embodiment of FIGS. 2 and 3. Further, many modifications will suggest themselves to those skilled in the pertinent art. For example, FIG. 12 depicts an alternative form of the double acting valve which may be used in all embodiments as a substitute for the previously depicted single element valve. This alternative valve structure employs two valve elments 722–724 urged apart by a spring 726 and into sealing engagement with a housing 728. A stem 730 is movable in the housing 728 to unseat the valve element 722. While the single element double-acting valve depicted in all embodiments supra has a slight deficiency in that it allows a small leakage flow in both directions before the single valve element seats, the alternative valve structure depicted in FIG. 12 does not have this deficiency.

The present invention has been described and depicted with reference to preferred embodiments thereof. However, such reference does not imply a limitation upon the invention and none is to be inferred. The invention is intended to be limited only by the spirit and scope of the appended claims which provide a definition of the invention.

I claim:

1. In an actuator for moving a load member in response to a flow of pressurized liquid from a source thereof, said actuator comprising a pair of variable-volume chambers expanding and contracting in response to movement of said load member, the method of purging gaseous fluid from said actuator comprising the steps of: communicating said pair of variable-volume chambers one with the other; flowing pressurized liquid in a first direction from said source sequentially through said pair of variable-volume chambers; and utilizing said flow of pressurized liquid to move said gaseous fluid from said actuator to said source of pressurized liquid, and including further the step of moving said actuator to one of a first add a second position in response to said flow of pressurized liquid through said communicating pair of variable-volume chambers, further including closing said fluid communication between said pair of variable-volume chambers in a second direction opposite to said first direction in response to a flow of pressurized liquid from said source in said second direction, and further including trapping in said actuator in response to said closing of said fluid communication in said second direction between said pair of variable-volume chambers a substantially closed mass of pressurized liquid having a substantially constant volume, including further the step of decreasing the volume of any gaseous fluid included in said mass of pressurized liquid by increasing the pressure level of the latter significantly above ambient pressure, including further the step of utilizing a flow of pressurized liquid from said source communicated from one of said pair of variable-volume chambers in said first direction to said mass of pressurized liquid to fill the volume by which said gaseous fluid is decreased in response to said increasing pressure level.

2. The method of claim 1 further including the step of impelling movement of said actuator from said one position toward the other of said first and second positions in response to a flow of pressurized liquid from said source to said actuator in said second direction.

3. The method of claim 2 further including the step of inhibiting movement of said actuator from said one position toward said other position until said pressure level of said mass of pressurized liquid attains a predetermined value.

4. The method of claim 2 including further the step of displacing from a storage location a predetermined quantity of said pressurized liquid mass in response to the pressure level of pressurized fluid flowing to said actuator from said liquid source during movement of said actuator between said first and second positions.

5. The method of claim 2 including further the step of displacing from a storage location a quantity of said pressurized liquid mass as a function of the pressure level of the latter.

6. The method of claim 2 including further the step of limiting the force exertable upon said load member by sensing a pressure differential between one of said pair of variable-volume chambers and said mass of pressurized liquid, and stopping said flow of pressurized liquid from said source to said actuator upon said pressure differential attaining a certain level.

7. The method of claim 2 further including the step of trapping another substantially closed mass of pressurized liquid having a substantially constant volume.

8. The method of claim 7 including further the step of limiting the force exertable upon said load member by sensing a second pressure differential between said mass of pressurized liquid and said another mass of pressurized liquid, and stopping said flow of pressurized liquid from said source to said actuator upon said second pressure differential attaining a second certain level.

9. The method of claim 2 further including the step of effecting movement of said actuator from said other position to said one position in response to a flow of pressurized liquid from said source to said actuator in said first direction.

10. The method of claim 9 including further the step of again purging gaseous fluid from said actuator by maintaining said flow of pressurized liquid in said first direction during a certain time period after the attainment of said one position by said actuator.

11. The method of claim 9 including further the step of inhibiting movement of said actuator from said other position toward said one position by said load member by sensing the pressure level of said mass of pressurized liquid, and closing communication of liquid from said actuator to said liquid source upon said pressure level decreasing to a determined value.

12. The method of claim 3 wherein said inhibiting step includes utilizing a latch device to secure said actuator in said one position, said latch device being responsive to said pressure level of said mass of pressurized liquid to unlatch said actuator.

13. The method of claim 12 including further the step of producing an intelligible signal in response to unlatching of said latch device.

14. The method of claim 13 further including the step of producing an intelligible signal in response to movement of said actuator from said one position.

15. The method of claim 12 wherein said inhibiting step further includes substantially closing communication of pressurized liquid from said source in said second direction to said actuator until said pressure level of said mass of pressurized liquid attains said predetermined value.

16. A fluid pressure responsive actuator comprising:

a fluid pressure source including a first port selectively connecting alternatively to supply fluid at a determined pressure, and to a relatively lower pressure fluid reservoir; and a second port continuously supplying fluid at said determined pressure;

at least a pair of motors each including a piston-cylinder assemblage cooperating to define a pair of working chambers of unequal effective area expanding and contracting in opposition in response to movement of said piston member thereof, and a pair of synchronizing chambers all expanding and contracting equally in opposition as said piston member moves, each of said motors further including flow path means interconnecting each one of said pair of working chambers individually with the one of said pair of synchronizing chambers expanding and contracting in opposition thereto, and valve means closing fluid flow in said flow path means in both directions and allowing fluid flow therein only in a direction toward the power chamber having the greater area of said pair of power chambers from the communicating synchronizing chamber, and from the other of said pair of power chambers toward the other of said pair of synchronizing chambers in a singular position of said piston members;

a first conduit interconnecting said working chambers of greater effective area of each of said motors and communicating with said first port;

a second conduit interconnecting said working chambers of lesser effective area of each of said motors and communicating with said second port;

a third conduit interconnecting a synchronizing chamber of one of said motors which expands in response to movement of the respective piston member in a selected direction with a synchronizing chamber of another motor contracting in response to movement of the respective piston member thereof in said selected direction; and a fourth conduit interconnecting the other synchronizing chamber of said one motor with a synchronizing chamber of another motor expanding in response to movement of the respective piston member thereof in said selected direction.

17. The invention of claim 16 further including volume compensation means for individually receiving and returning fluid volume from said third and fourth conduits in response to the fluid pressures within said first and second conduits and the relationship of the latter, whereby the fluid volumes composed of connected synchronizing chambers and respective conduits is reduced in accord with effective compression thereof to counteract said effective fluid compression and maintain movement synchronization of said motors.

18. The invention of claim 17 wherein said volume compensation device comprises a housing and a stepped piston member reciprocable therein, said housing and piston member cooperating to define a pair of opposite end chambers of equal effective area expanding and contracting in opposition in response to relative movement thereof, means communicating said opposite end chambers individually to respective ones of said third and fourth conduits, said housing and piston member further cooperating to define a pair of intermediate chambers of differing effective area also expanding and contracting in opposition, means communicating the one of said pair of intermediate chambers having the greater effective area to said first conduit, and means communicating the other of said pair of intermediate chambers with said second conduit.

19. The invention of claim 16 wherein said pair of power chambers and said pair of synchronizing chambers are coaxial with one chamber of the former pair and one chamber of the latter pair being coannular.

20. A fluid pressure motor comprising:

a piston-housing assemblage including means for defining a pair of power chambers of unequal area and a pair of synchronizing chambers of equal area, each individual pair of chambers expanding and contracting in opposition in response to relative movement of a piston member and a housing member of said assemblage, first flow path means communicating one of said pair of power chambers individually to the one of said pair of synchronizing chambers expanding and contracting in opposition thereto, and second flow path means connecting the other of said pair of power chambers individually with the other of said pair of synchronizing chambers, first and second valve means respectively disposed in said first and second flow path means for closing fluid flow therethrough in both directions and for allowing fluid flow therein only in a singular position of said piston member relative to said housing member.

21. In an aircraft having a jet propulsion engine, a thrust reverser element in association with said engine for reversing the direction of thrust provided by said engine, and a liquid pressure responsive actuator moving said thrust reverser element between a stowed position and a deployed thrust reversing position, said actuator comprising a pair of liquid pressure responsive motors, each one of said pair of motors including a respective output member movable between a first and a second position to move said reverser element respectively between said stowed and deployed positions, flow path means communicating said pair of motors, fluid pressure source means communicating with each one of said pair of motors, said pair of motors including valve means opening only when both of said output members occupy said first position for allowing fluid flow from said source through said pair of motors and to said source, said actuator including said pair of liquid pressure responsive motors moving in substantial synchronization between said first and a second position to move said thrust reverser element respectively between said stowed and said deployed positions, each one of said pair of motors defining a variable-volume chamber receiving pressurized liquid from a source thereof to move said actuator, said variable-volume chambers being capable also of receiving gaseous fluid, and purging means for so communicating said pair of variable-volume chambers with said source of pressurized liquid so as to substantially remove said gaseous fluid from said pairs of chambers to said liquid source, said purging means further including means for moving each one of said pair of motors to one of said first and second position, in response to a flow of pressurized liquid from said source, said actuator including pressure responsive retaining means for securing said actuator in one of said first and second positions, said retaining means being responsive to a flow of pressurized liquid from said source to release said actuator from said one position, said purging means further cooperating with said actuator to substantially define a closed volume trapping therein a determined quantity of pressurized liquid from said source, said trapped liquid moving between said pair of motors in response to movement of the latter between said first and second positions, and volume compensation means cooperating with the remainder of said actuator to define said closed volume, said volume compensation means comprising apparatus for displacing pressurized liquid from a storage location thereof into said trapped liquid in response to a flow of pressurized liquid from said source thereof.

22. The method of synchronizing movement of a pair of hydraulic motors, each motor comprising a pair of power chambers of unequal effective area and a pair of equal effective area synchronizing chambers, the chambers of each pair of chambers expanding and contracting in opposition in response to operation of the respective motor, said method comprising the steps of providing flow path means communicating each synchronizing chamber individually with the power chamber of the respective motor expanding and contracting in opposition thereto; and flowing fluid through said pair of motors in a first direction sequentially from a source thereof through a synchronizing chamber and the power chamber of greater effective area communicating therewith and to said source, and from said source sequentially through the other of said pair of power chambers and the other of said pair of synchronizing chambers and to said source; and employing said fluid flow in said first direction through said pair of motors to purge gaseous fluid therefrom to said source, further including the steps of discontinuing fluid flow in said first direction from said power chambers of greater effective area to said source, while continuing fluid flow in said first direction from said source through said other power chambers to said other synchronizing chambers, and utilizing said continuing fluid flow to compress gaseous fluid (if any) within said pair of motors and filling the volume by which said gaseous fluid is compressed with incompressible fluid.

* * * * *